US009090076B2

(12) United States Patent
Ma

(10) Patent No.: US 9,090,076 B2
(45) Date of Patent: Jul. 28, 2015

(54) INK CARTRIDGE USED FOR AN INKJET PRINTER

(75) Inventor: Haoming Ma, Guangdong (CN)

(73) Assignee: ZHUHAI NINESTAR MANAGEMENT CO., LTD., Zhuhai, Guangdong (CN)

( * ) Notice: Subject to any disclaimer, the term of this patent is extended or adjusted under 35 U.S.C. 154(b) by 0 days.

(21) Appl. No.: 13/520,022

(22) PCT Filed: Nov. 22, 2010

(86) PCT No.: PCT/CN2010/078937

§ 371 (c)(1),
(2), (4) Date: Jun. 29, 2012

(87) PCT Pub. No.: WO2011/085617

PCT Pub. Date: Jul. 21, 2011

(65) Prior Publication Data

US 2012/0281040 A1 Nov. 8, 2012

(30) Foreign Application Priority Data

Jan. 14, 2010 (CN) ..... 2010 2 0056489

(51) Int. Cl.
*B41J 29/393* (2006.01)
*B41J 2/175* (2006.01)

(52) U.S. Cl.
CPC ..... *B41J 2/17513* (2013.01); *B41J 2/1752* (2013.01); *B41J 2/17553* (2013.01); *B41J 2/17566* (2013.01)

(58) Field of Classification Search
CPC ..... B41J 2/17566; B41J 2/17503; B41J 2002/17576; B41J 2002/17573; B41J 2002/17566
USPC ..... 347/84–86, 19
See application file for complete search history.

(56) References Cited

U.S. PATENT DOCUMENTS

| | | | | |
|---|---|---|---|---|
| 2005/0270341 | A1* | 12/2005 | Yamamoto et al. | 347/85 |
| 2007/0070147 | A1* | 3/2007 | Hattori et al. | 347/86 |
| 2009/0058962 | A1* | 3/2009 | Kanbe et al. | 347/86 |
| 2009/0213159 | A1* | 8/2009 | Aoki et al. | 347/14 |
| 2010/0265305 | A1* | 10/2010 | Qin et al. | 347/86 |

FOREIGN PATENT DOCUMENTS

JP 2000-198222 A * 7/2000 ..... B41J 2/175

* cited by examiner

*Primary Examiner* — Stephen Meier
*Assistant Examiner* — Sharon A Polk
(74) *Attorney, Agent, or Firm* — Jackson IPG PLLC; Demian K. Jackson

(57) ABSTRACT

An ink cartridge used for an inkjet printer, with an ink storage chamber, an ink outlet and an air inlet, and a detection component designed inside the ink storage chamber for detecting residual ink volume. The ink storage chamber includes an ink detection chamber and a relatively enclosed ink refilling chamber with an opening at a lower part. The opening of the ink refilling chamber is inside the ink detection chamber. The detection component is designed inside the ink detection chamber.

8 Claims, 6 Drawing Sheets

INK CARTRIDGE USED FOR AN INKJET PRINTER

FIELD OF THE INVENTION

This invention relates to an ink cartridge used for an inkjet printer.

BACKGROUND OF THE INVENTION

In the present inkjet printing technical field, an inkjet recording system generally comprises a transfer mechanism, a paper feeding mechanism, a control mechanism, a correction mechanism and a cleaning mechanism etc. Through systematical combination and integration, these mechanisms constitute a complete printer, wherein the transfer mechanism comprises a spray nozzle, an ink channel and an ink supply system.

The transfer mechanism is in "on-line" or "off-line" mode. The so-called "on-line" mode means that the printer's ink refilling mechanism, namely, ink cartridge is on a printing head and shuttles together with its moving axis. The ink cartridge of such mode moves together with the printing head. The ink inside the ink cartridge is often vibrated and is prone to form an air-liquid mixture with air. However, in the vibration process, the ink becomes uniform to avoid of deposit.

The "off-line" mode means that the ink cartridge and the printing head are connected via an ink supply pipe, and the ink cartridge fixed inside the ink cartridge chamber, does not move together with the printing head. The ink cartridge of such mode has stable position to avoid of forming an air-liquid mixture, but is apt to deposit.

As to the "off-line" mode, an ink volume detection system usually uses the analog information like chip for the detection. In order to ensure the accuracy of detection, it is provided with the material detection at the same time, namely physical detection of the ink volume information.

The physical detection usually uses light detection method, that is to say, light emitting portion on one end of a printer detection sensor emits the light, while a light receiving portion on the other end receives the light. When the receiving portion can't receive the light, the printer makes prompt that the ink is completely consumed. Therefore, the ink cartridge matching the printer needs a corresponding detection device to block or change the light path. Meanwhile, it must also reflect the true ink volume information.

However said inkjet printer is widely installed with an ink volume optical detection unit comprising a light-emitting portion and a light receiving portion, and the terminals on the ink cartridge that the ink volume inside an ink cartridge is detected through the exchange of electronic signals generated by contacts among terminals on the ink cartridge. However, problem usually occurs due to poor contact caused by the ink adhesion. Therefore, to prevent this problem, it is preferable to use an optical detection unit like an optical sensor.

In addition, it is widely known that the ink cartridge structure be installed on a main body in a irremovable manner. The printer with said structure different from the structure with an ink cartridge on a carriage, the ink cartridge does not move in the printing process, so ink bubble will not appear.

Therefore, a new art is proposed in Patent US20070229616, wherein a light blocking portion with rotable portion function is configured for detecting the residual ink volume This light blocking portion is connected to a hollow floater portion via a movable arm and moves as the residual ink volume changes. Furthermore, when the residual ink volume is insufficient, the light blocking portion departs from a blocking position between the light emitting portion and the light receiving portion. The printer prompts that the ink is consumed. However, this method only serves as a prompt to user when the ink is consumed and can't accurately reflect the residual ink volume.

Therefore in Patent US20090184991, an ink cartridge is invented that can accurately prompt the residual ink amount. As shown in FIG. 1, this ink cartridge also uses a floater and a plurality of light blocking portions and transmitting portions. As the ink level becomes lower, the position of a floating component changes. The blocking portions continuously block the light between the light emitting portion and light receiving portion by several times. A counter will judge the ink volume inside the ink cartridge according to the blocking times.

In theory, said detection method can prompt the ink volume accurately, but the effect is not ideal in the practice, which is mainly caused by that 1. As a mechanism is complicated, many components like connecting arm or encoding board are used to connect the floater to the blocking portions. Due to the influence by a surface tension of the ink, such components are often adhered to a side wall of an ink storage chamber, which leads to inaccurate detection.

2. As the detection mechanism comprises many components like blocking portion, floater, connecting rod and fixing shaft, it imposes high requirement on the cost and technique of the installation and components, which increases the cost and manufacturing difficulty of the ink cartridge in an intangible manner.

SUMMARY OF THE INVENTION

This invention provides an ink cartridge used for an inkjet printer to solve the technical problems of prior ink cartridge used for the inkjet printer in respect of complicated structure, high cost and manufacturing difficulty when providing the ink volume data in all phases during the ink consumption.

To solve the above technical problems, this invention uses the following technical proposal:

An ink cartridge used for an inkjet printer, comprising an ink storage chamber for storing the ink, an ink outlet for supplying the printer with the ink and an air inlet for air going into the ink cartridge to maintain the pressure balance, a detection component is designed inside the ink storage chamber for detecting the residual ink volume, characterized in that said ink storage chamber comprises an ink detection chamber and a relatively enclosed ink refilling chamber with an opening at the lower part; said opening of the ink refilling chamber is inside said ink detection chamber; said detection component is inside said ink detection chamber.

Said detection component comprises a blocking portion and a floating portion connecting to the blocking portion; said blocking portion moves along with the floating portion.

Said detection component is made of a light absorption material designed in the ink.

Said detection component comprises a first reflector set designed at the upper part of the ink detection chamber and corresponding to the position of a light-emitting component and a second reflector set designed at the bottom of the ink detection chamber. When the ink within the ink detection chamber is unconsumed, the light emitted by said light-emitting component of the printer is emitted to the second reflector set by the first reflector set and then is refracted, so that the light can't return to a light-receiving component of the printer; when the ink within the ink detection chamber is completely consumed, the light emitted by said light-emitting component is emitted to the second reflector set by the first reflector set, then is reflected to the first reflector set, and then is reflected to the light-receiving component of the printer, so that the light emitted by the light-emitting component returns to the light-receiving component after being reflected by the first reflector set and the second reflector set.

Said first reflector set comprises a first reflector that receives the light emitted by the light-emitting component of the printer and reflects it to the second reflector set and a fourth reflector that receives the light reflected by the second reflector set reflects it to the light-receiving component of the printer; said second reflector set comprises a second reflector that receives the light reflected by the first reflector and reflects it and a third reflector that receives the light reflected by the second reflector and reflects it to the fourth reflector.

Said first reflector set is a first prism and said second reflector set is a second prism.

Said first reflector set is convex mirror and said second reflector set is concave mirror.

Said light absorption material is selected from a liquid Carbon nanotube, Phthalocyanine, 2,3-Naphthalocyanine, Squarine (squaric acid derivative), Croconic acid derivative, substituted indanthrone and highly substituted anthraquinone.

Said ink detection chamber has one end connected to the air inlet and one end connected to the ink outlet.

Said ink storage chamber also comprises an ink chamber.

After the above technical proposal is used, as the ink storage chamber comprises an ink detection chamber and a relatively enclosed ink refilling chamber with an opening at the lower part. The opening of the ink refilling chamber is inside the ink detection chamber. The detection component is designed inside the ink detection chamber. After the ink cartridge is installed, the ink level goes down gradually to a position a little lower than the opening at the lower part of the ink refilling chamber as the printing goes on. Meanwhile, the detection mechanism goes down, no longer blocking the light sent by a sensor. When the level continues going down, the surface tension of the ink is not sufficient to maintain the ink inside the ink refilling chamber. The ink inside the ink refilling chamber is refilled into the ink detection chamber. The detection mechanism blocks the sensor of the printer again. This process is repeated several times till the ink inside the ink refilling chamber is completely consumed. Detecting the ink volume according to the blocking times, this ink cartridge features simple structure, low cost and low manufacturing difficulty. It solves the technical problems of prior ink cartridge used for an inkjet printer in respect of complicated structure, high cost and manufacturing difficulty when providing the residual ink volume data in all phases during the ink consumption.

DETAILED DESCRIPTION OF THE EMBODIMENTS

The embodiments of said invention are described with reference to the drawings. First, brief description is made on the installation mechanism of the ink cartridge and the inkjet recording system. The inkjet recording system generally comprises a transfer mechanism, a paper feeding mechanism, a control mechanism, a correction mechanism and a cleaning mechanism etc. Through systematical combination and integration, these mechanisms constitute a complete printer, where the transfer mechanism comprises a spray nozzle, and ink channel and an ink supply system.

Figure 1:
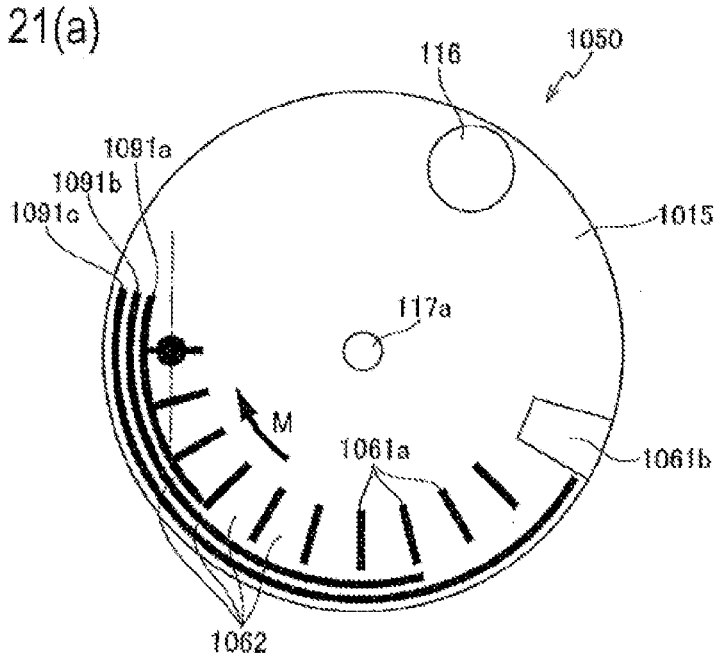
Fig. 1 (Prior Art)
FIG. 1 is a view showing prior ink volume detection device.
Figure 2:
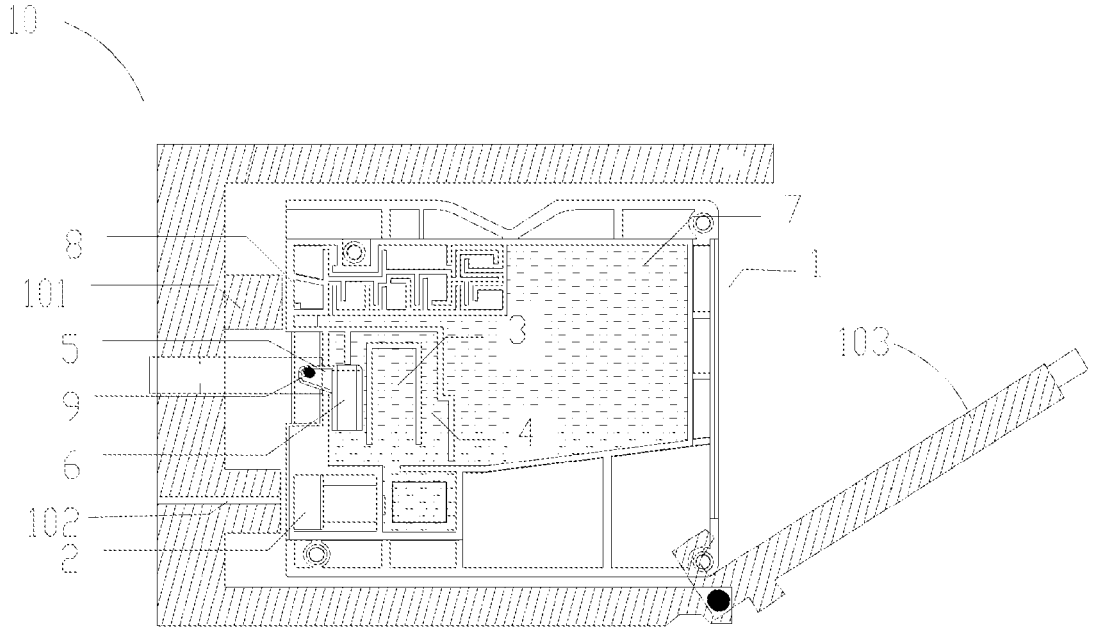
FIG. 2 is a view showing this invention after being installed.

The ink supply system comprises ink cartridge detection, ink detection and ink supply mechanisms. As shown in FIG. 2, the ink cartridge chamber 10 comprises ink cartridge detection, ink level detection and ink supply mechanisms, wherein the sensor 9 undertakes the functions of ink cartridge detection and ink volume detection, while the ink supply outlet 102 of the ink cartridge chamber 10 and the ink outlet 2 and the air inlet 8 of the ink cartridge 1 (if the ink bag is used, the air inlet 8 may not be used) constitute the ink supply mechanism.

The ink cartridge chamber also comprises a protrusion 101 for the air intake together with the air inlet 8 of the ink cartridge 1 and fixing the ink cartridge 1 together with the ink cartridge chamber 10. In addition, the ink cartridge chamber cover 103 fixes the ink cartridge through all walls of the ink cartridge chamber 10. The preferable ink cartridge chamber cover 103 is articulated with the ink cartridge chamber 10 so that the ink cartridge is easily installed and removed by the user.

Embodiment 1

The ink cartridge comprises an ink storage chamber for storing the ink, the ink outlet 2 for supplying the printer with the ink and the air inlet 8 for the air going into the ink cartridge to maintain the pressure balance. A detection component is designed inside the ink storage chamber for detecting the residual ink volume. The ink storage chamber comprises an ink detection chamber, a relatively enclosed ink refilling chamber with an opening at the lower part and an ink chamber. The opening of the ink refilling chamber is inside said ink detection chamber. The detection component is inside said ink detection chamber. The detection components are the blocking portion 5 and the floating portion 6. As the ink level changes, the position of the blocking portion 5 changes accordingly, so as to detect the residual ink volume.

During the detection, the printer detects the ink consumption, that is to say, as the ink level changes, the light path is blocked or changed by several times. Therefore, the ink refilling chamber 3 and the ink detection chamber 4 are designed in the ink cartridge 1, the ink volume of the ink detection chamber 4 can be fed back to the detection component. To reduce the influence to the detection, the ink cartridge can also be designed with the ink chamber 7 which can store some ink, reducing the influence to the detection precision. The preferable ink refilling chamber 3 is in rectangle shape, with bulkhead separated from the ink detection chamber 4 at the upper part and connected to the ink detection chamber 4 at lower part.

Figure 3:
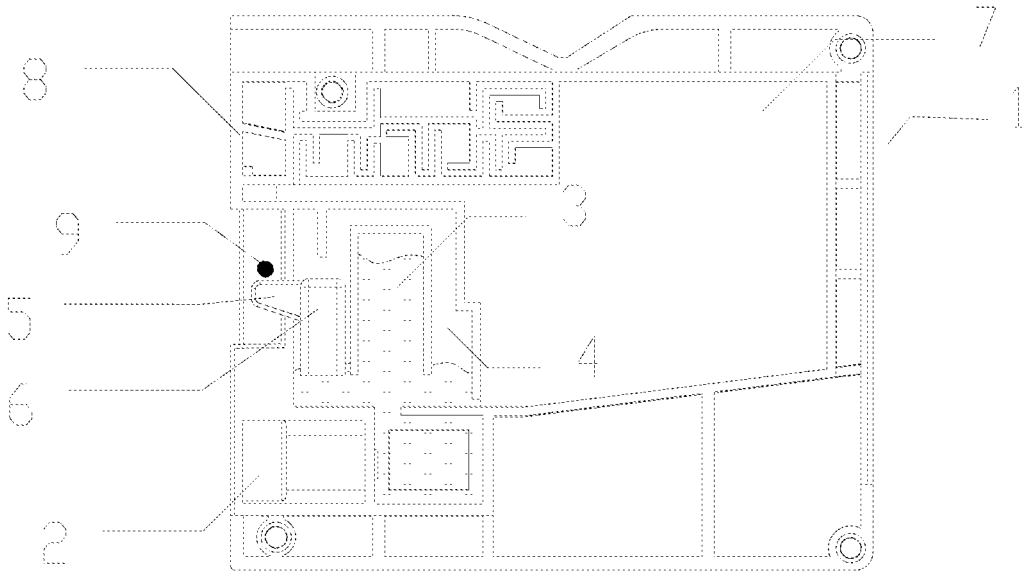
FIG. 3 is a view showing the ink level inside the chamber during the $1^{st}$ detection in Embodiment 1.
Figure 4:
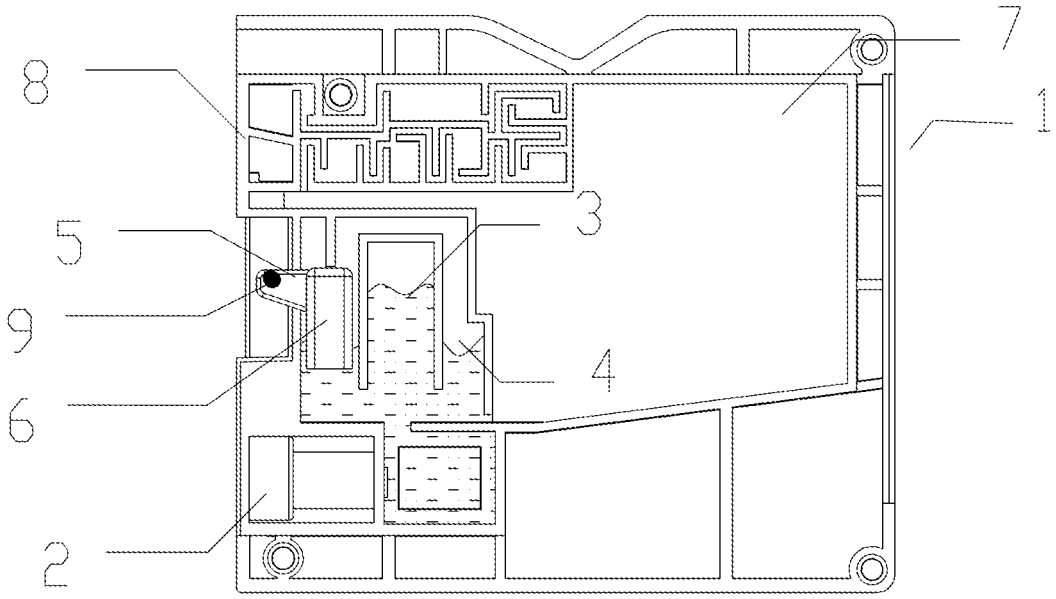
FIG. 4 is a view showing the ink level inside the chamber during the $N^{th}$ detection in Embodiment 1.
Figure 5:
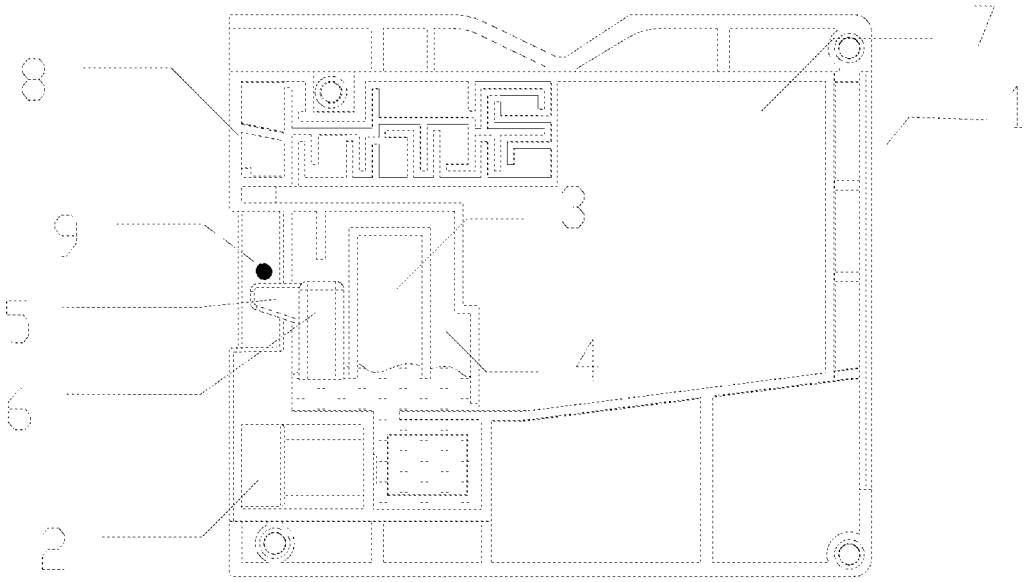
FIG. 5 is a view showing the ink level after the ink level detection in Embodiment 1.

After the ink cartridge is installed (as shown in FIG. 2), the sensor 9 is blocked by the blocking portion 5 of the ink cartridge 1. When the ink level within the ink cartridge 1 goes down gradually to a position a little lower than the opening at the lower part of the ink refilling chamber 3 as the printing goes on (as shown in FIG. 3). Meanwhile, the floating portion 6 and the blocking portion 5 of the ink cartridge 1 go down, no longer blocking the light emitted by the sensor 9. When the level continues going down, the surface tension of the ink is not sufficient to maintain the ink inside the ink refilling chamber 3. The ink inside the ink refilling chamber 3 is refilled into the ink detection chamber 4 (as shown in FIG. 4). The blocking portion 5 blocks the sensor 9 again. This process is repeated several times till the ink inside the ink refilling chamber is completely consumed. The blocking portion 5 and the floating portion 6 will not go up (as shown in FIG. 5). The printer will prompt that the ink in the ink cartridge is absent and the ink cartridge must be changed according to the program after printing more 2-3 ml ink.

Figure 6:
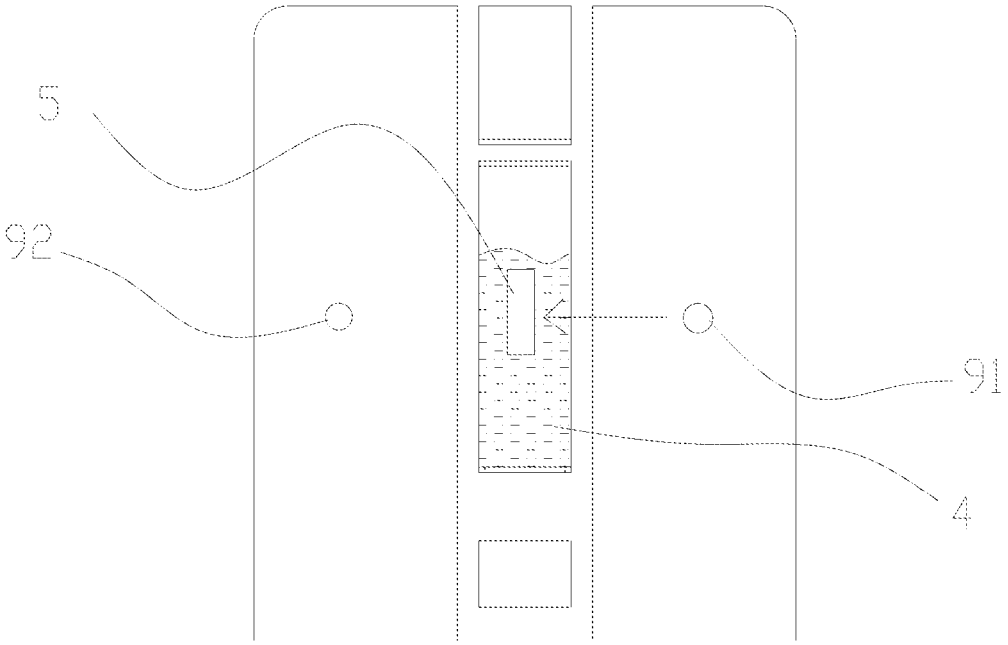
FIG. 6 is a view showing the detection component blocking the sensor light in Embodiment 1.

As shown in FIG. 6, when the blocking portion 5 is between the light emitting portion 91 and the light receiving portion 92 of the sensor 9 under the ink buoyancy, it blocks the light emitted by the light emitting portion 91, so that the light receiving portion 92 can't receive the light.

Figure 7:
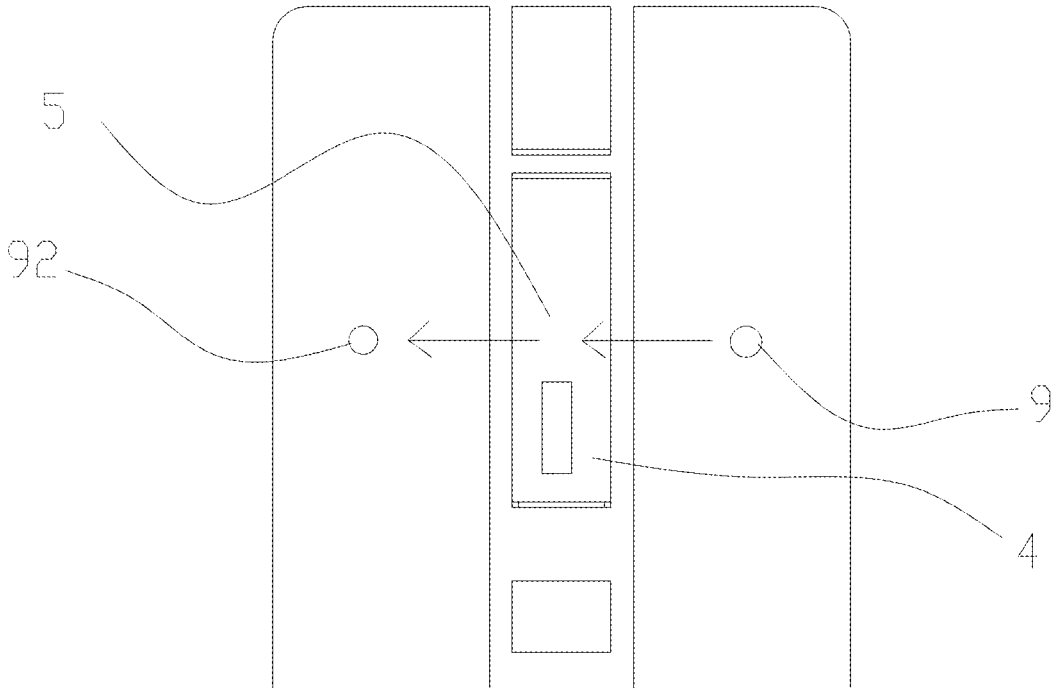
FIG. 7 is a view showing the detection component not blocking the sensor light in Embodiment 1.

As shown in FIG. 7, when the ink level goes down, the blocking portion 5 goes down and departs from the blocking position at the same time. Therefore, the light emitted by the light emitting portion 91 of the sensor 9 is received by the light receiving portion 92.

Embodiment 2

Figure 8:
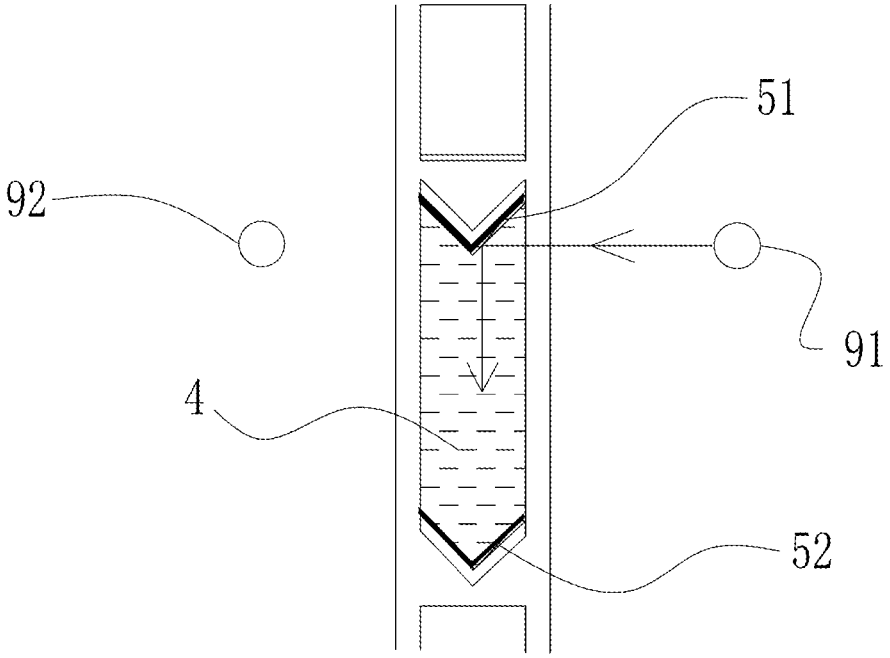
FIG. 8 is a view showing the detection component blocking the sensor light in Embodiment 2.

As shown in FIG. 8, the detection component that works with the above ink cartridge refilling chamber 3 and the ink detection chamber 4 can also be a set of prisms, where the first prism 51 is between the light emitting portion 91 and the light receiving portion 92 of the sensor 9 and the second prism 52 is just under the first prism 51. When the ink is present between the first prism 51 and the second prism 52, the ink blocks the light transmission, so that the light receiving portion 92 can't receive the light. Therefore, the light is blocked.

Figure 9:
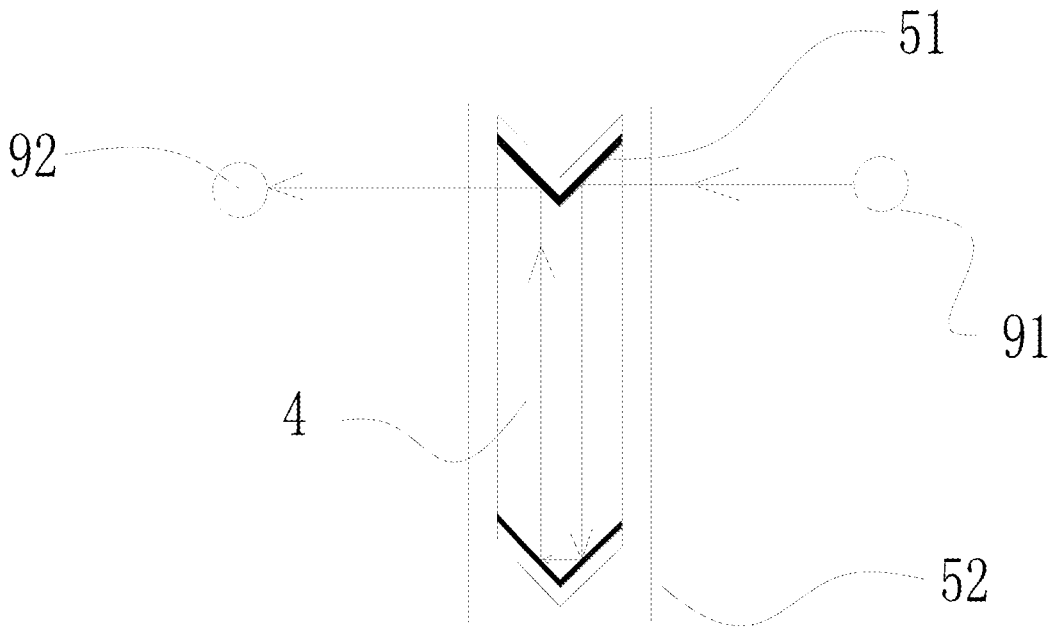
FIG. 9 is a view showing the detection component not blocking the sensor light in Embodiment 2.

As shown in FIG. 9, when the ink level goes down and the ink is absent between the first prism 51 and the second prism 52, the first prism 51 and the second prism 52 reflect the light emitted by the light emitting portion 91, so that light receiving portion 92 receives the light. Therefore, the ink level is detected.

When the detection component like prism works with the ink refilling chamber 3 and the ink detection chamber 4, the level in the ink cartridge detection chamber can be made to go up and down several times to realize the detection. Such detection components can be combined with the art in this patent to perform the ink volume detection.

Certainly, the detection component can also be a first reflector set designed at the upper part of the ink detection chamber and matching the position of the printer light-emitting component of the printer and a second reflector set designed at the bottom of the ink detection chamber. When the ink within the ink detection chamber is unconsumed, the light emitted by said light-emitting component of the printer is emitted to the second reflector set by the first reflector set and then is refracted, so that the light can't return to the light-receiving component of the printer; when the ink within the ink detection chamber is completely consumed, the light emitted by said light-emitting component of the printer is emitted to the second reflector set by the first reflector set, then is reflected to the first reflector set and then is reflected to the light-receiving component of the printer, so that the light emitted by the light-emitting component of the printer returns to the light-receiving component of the printer after being emitted by the first reflector set and the second reflector set. The first reflector set comprises a first reflector that receives the light emitted by the light-emitting component of the printer and reflects it to the second reflector set and a fourth reflector that receives the light reflected by the second reflector set reflects it to the light-receiving component of the printer; the second reflector set comprises a second reflector that receives the light reflected by the first reflector and reflects it and a third reflector that receives the light reflected by the second reflector and reflects it to the fourth reflector. For example, the first reflector set is convex mirror, while the second reflector set is concave mirror.

Embodiment 3

Figure 10:
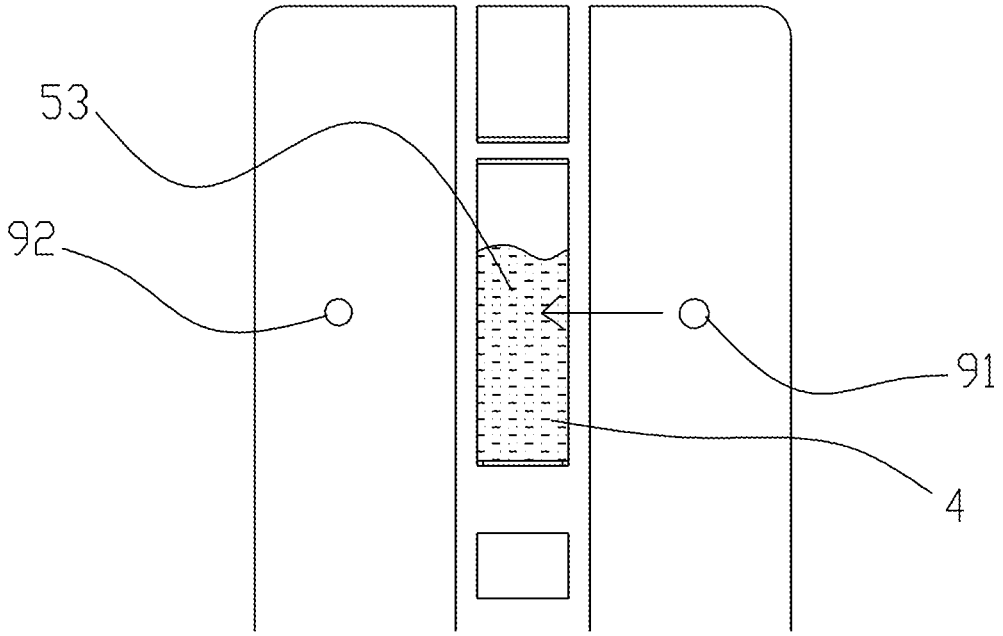
FIG. 10 is a view showing the detection component blocking the sensor light in Embodiment 3.

As shown in FIG. 10, the detection component that works with the above ink cartridge refilling chamber 3 and the ink detection chamber 4 can also be the ink 53 added with the light absorption material. As the ink with different color has different light transmission properties (lowest for black and highest for yellow), light absorption material must be added into the ink. The light absorption material may be liquid Carbon nanotube (C70), or Phthalocyanine, 2,3-Naphthalocyanine, Squarine (squaric acid derivative), Croconic acid derivative, substituted indanthrone and some highly substituted anthraquinone. When the ink 53 added with the light absorption material is present on the detection component between the light emitting portion 91 and the light receiving portion 92 of the sensor 9, the light emitted by the light emitting portion 91 is absorbed by the ink, so that the light receiving portion 92 can't receive the light. Therefore, the light is blocked.

Said light absorption material is C70 that is soluble in the ink. C70 molecule consists of 70 carbon atoms and is of rugby ball shape. C70 molecule is insoluble in the water. However, after liposome is added into the mixture of C70 and cyclic oligosaccharide, C70 molecule can be wrapped by the liposome. The wrapped C70 is soluble in the water. It also includes other substances like Phthalocyanine, 2,3-Naphthalocyanine, Squarine (squaric acid derivative), Croconic acid derivative, substituted indanthrone and some highly substituted anthraquinone etc.

Figure 11:
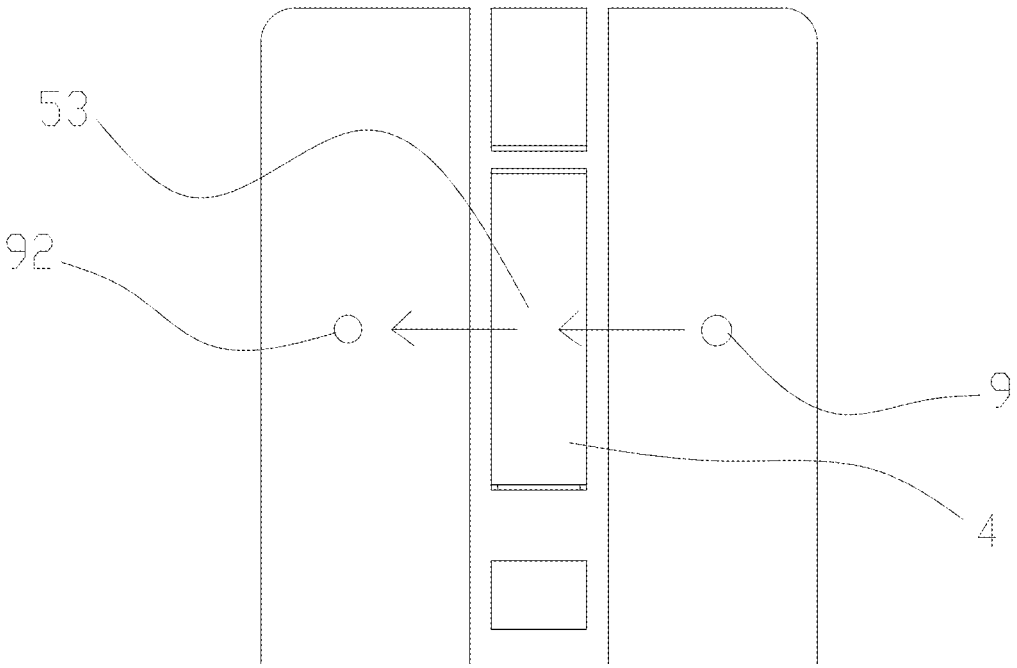
FIG. 11 is a view showing the detection component blocking the sensor light in Embodiment 3.

As shown in FIG. 11, when the ink level goes down and the ink is absent between the light emitting portion 91 and the light receiving portion 92 of the sensor 9, the light emitted by the light emitting portion 91 can be received by the light receiving portion 92. Therefore, the ink level is detected.

Therefore, the ink level detection component is not limited to the above three forms. All ink detection methods by using the ink level based on the above variants are within the protection scope of this invention.

What is claimed is:

1. An ink cartridge used for an inkjet printer comprising a sensor, the ink cartridge comprising an ink storage chamber for storing ink, an ink outlet for supplying the printer with the ink and an air inlet for air going into the ink cartridge to maintain a pressure balance, and a detection component designed inside the ink storage chamber and arranged to block the sensor for detecting an ink level, characterized in that said ink storage chamber comprises an ink detection chamber and a relatively enclosed ink refilling chamber with an opening at a lower part; said ink refilling chamber opening is inside said ink detection chamber; said detection component is inside said ink detection chamber such that, when the ink level of the ink detection chamber goes down to a position lower than the opening of the ink refilling chamber, the detection component goes down to a position lower than the opening of the ink refilling chamber and the detection component does not block the sensor; then the ink of the ink refilling chamber is refilled into the ink detection chamber and the detection component blocks the sensor again.

2. The ink cartridge used for the inkjet printer according to claim 1, wherein said detection component comprises a blocking portion and a floating portion connected to the blocking portion; said blocking portion moves along with the floating portion.

3. The ink cartridge used for the inkjet printer according to claim 1, wherein said detection component comprises a first reflector set designed at the upper part of the ink detection chamber and corresponding to the position of the printer light-emitting component and a second reflector set designed at the bottom of the ink detection chamber, when the ink within the ink detection chamber is unconsumed, the light emitted by said light-emitting component of the printer is emitted to the second reflector set by the first reflector set and then is refracted, so that the light can't return to the light-receiving component of the printer; when the ink within the ink detection chamber is completely consumed, the light emitted by said light-emitting component is emitted to the second reflector set by the first reflector set, then is reflected to the first reflector set, and then is reflected to the light-receiving component of the printer, so that the light emitted by the light-emitting component returns to the light-receiving component after being reflected by the first reflector set and the second reflector set.

4. The ink cartridge used for the inkjet printer according to claim 3, wherein said first reflector set comprises a first reflector that receives the light emitted by the light-emitting component of the printer and reflects it to the second reflector set and a fourth reflector that receives the light reflected by the second reflector set and reflects it to the light-receiving component of the printer; said second reflector set comprises a second reflector that receives the light reflected by the first reflector and reflects it and a third reflector that receives the light reflected by the second reflector and reflects it to the fourth reflector.

5. The ink cartridge used for the inkjet printer according to claim 3, wherein said first reflector set is a first prism and said second reflector set is a second prism.

6. The ink cartridge used for the inkjet printer according to claim 3, wherein said first reflector set is convex mirror and said second reflector set is concave mirror.

7. The ink cartridge used for the inkjet printer according to claim 1, wherein said ink detection chamber has one end connected to the air inlet and one end connected to the ink outlet.

8. The ink cartridge used for the inkjet printer according to claim 1, wherein said ink storage chamber also comprises an ink chamber.

* * * * *